US007322871B2

(12) United States Patent
Lambertini et al.

(10) Patent No.: US 7,322,871 B2
(45) Date of Patent: Jan. 29, 2008

(54) PROCESS TO MAKE NANO-STRUCTURED EMITTERS FOR INCANDESCENCE LIGHT SOURCES

(75) Inventors: Vito Lambertini, Giaveno (IT); Daniele Pullini, Orbassano (IT); Nello Li Pira, Fossano (IT); Mauro Brignone, Orbassano (IT); Piermario Repetto, Orbassano (IT); Marzia Paderi, Turin (IT); Rossella Monferino, Turin (IT)

(73) Assignee: CRF Societa Consortile per Azioni, Orbassano (Torino) (IT)

( * ) Notice: Subject to any disclaimer, the term of this patent is extended or adjusted under 35 U.S.C. 154(b) by 0 days.

(21) Appl. No.: 10/523,214

(22) PCT Filed: Dec. 23, 2003

(86) PCT No.: PCT/IB03/06338

§ 371 (c)(1),
(2), (4) Date: Jan. 27, 2005

(87) PCT Pub. No.: WO2004/079774

PCT Pub. Date: Sep. 16, 2004

(65) Prior Publication Data

US 2006/0103286 A1 May 18, 2006

(30) Foreign Application Priority Data

Mar. 6, 2003 (IT) ..... TO2003A0167

(51) Int. Cl.
*H01K 1/14* (2006.01)

(52) U.S. Cl. ..... 445/48; 313/341

(58) Field of Classification Search ..... 445/48–50; 313/315, 341–345; 216/11
See application file for complete search history.

(56) References Cited

U.S. PATENT DOCUMENTS

| | | | | |
|---|---|---|---|---|
| 5,079,473 | A | 1/1992 | Waymouth | |
| 5,686,791 | A * | 11/1997 | Kumar et al. | 313/495 |
| 5,777,427 | A * | 7/1998 | Tanaka et al. | 313/309 |
| 6,139,713 | A * | 10/2000 | Masuda et al. | 205/206 |
| 6,278,231 | B1 * | 8/2001 | Iwasaki et al. | 313/310 |
| 6,309,554 | B1 * | 10/2001 | Fujishima et al. | 216/11 |
| 2002/0096107 | A1 * | 7/2002 | Fujishima et al. | 117/94 |
| 2002/0121851 | A1 * | 9/2002 | Yasui et al. | 313/310 |
| 2004/0175844 | A1 * | 9/2004 | Yang et al. | 438/2 |

FOREIGN PATENT DOCUMENTS

| | | | |
|---|---|---|---|
| JP | 2000 243 247 A | | 9/2000 |
| JP | 2000 267 585 A | | 9/2000 |
| WO | WO 03/019680 | * | 3/2003 |

OTHER PUBLICATIONS

Hideki Masuda et al.: "Preparation of Microourous Metal Membranes by Two-Step Replication of the microstructure of Anodic Alumina" Thin Solid Films, Elsevier-Sequoia S.A. Lausanne, CH, vol. 223, No. 1, Jan. 15, 1993, pp. 1-3 XP000367988.

* cited by examiner

*Primary Examiner*—Karabi Guharay
*Assistant Examiner*—Christopher M. Raabe
(74) *Attorney, Agent, or Firm*—Sughrue Mion, PLLC.

(57) ABSTRACT

In a process to make an emitter (10) for light sources, which can be led to incandescence through the passage of electric current, a layer made of anodized porous alumina (1) is used as sacrificial element for the structuring of at least a part of the emitter (10).

22 Claims, 10 Drawing Sheets

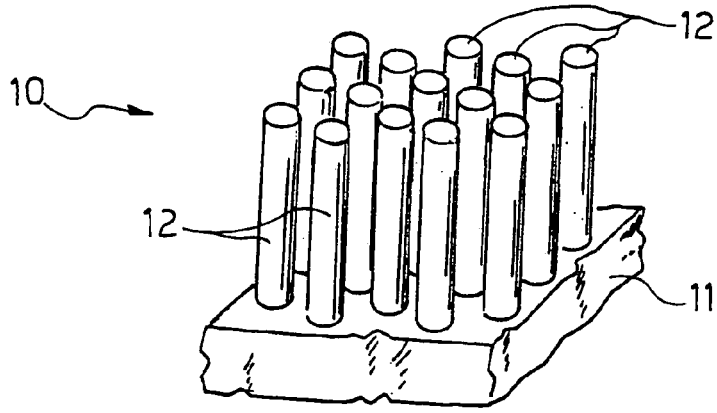
FIG. 6
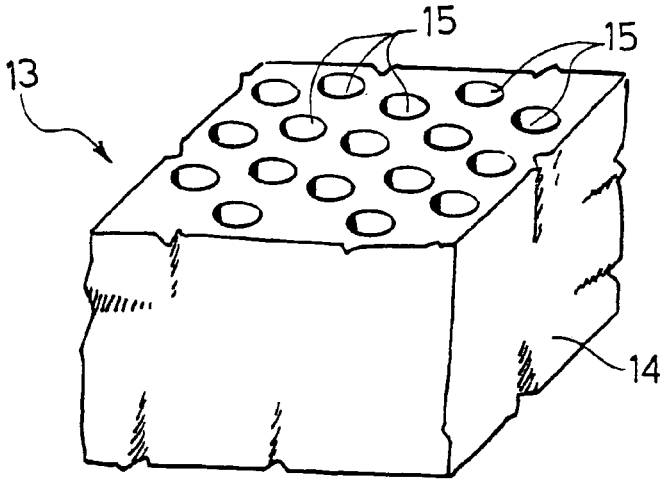
FIG.7
FIG. 8
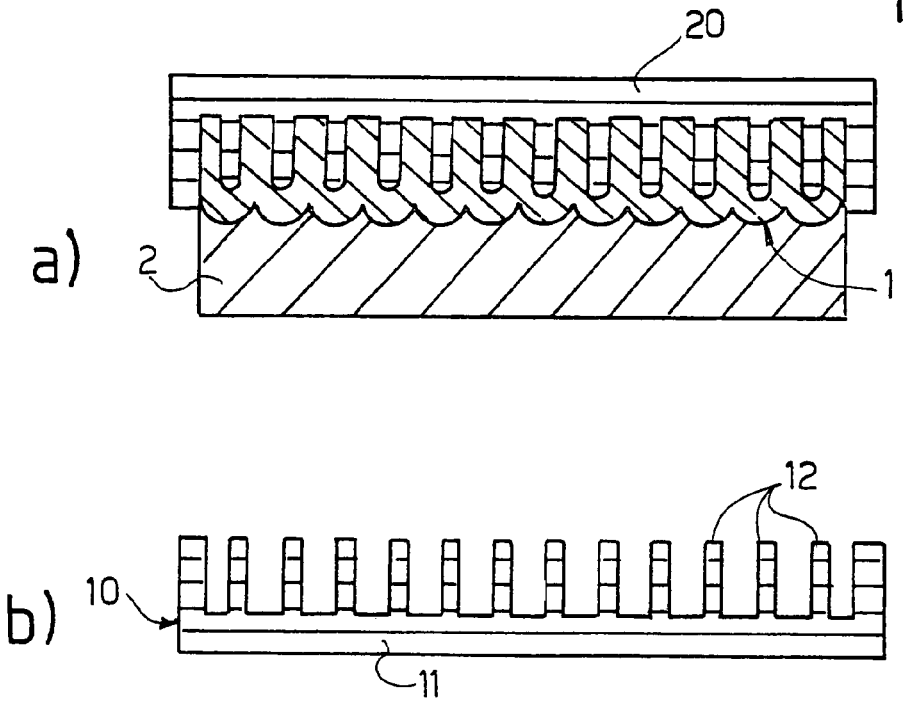

PROCESS TO MAKE NANO-STRUCTURED EMITTERS FOR INCANDESCENCE LIGHT SOURCES

This is a National Stage entry of Application PCT/IB2003/006338, with an international filing date of Dec. 23, 2003, which was published under PCT Article 21(2) as WO 2004/079774 A1, and the complete disclosure of which is incorporated into this application by reference.

BACKGROUND OF THE INVENTION

The present invention relates to a process to make a nano-structured emitter element for light sources, which can be led to incandescence through the passage of electric current.

Metal components having nanometric surface structures or reliefs, arranged according to specific shapes or geometries, are currently used in some technological fields, such as micro electro-mechanical systems or MEMS, so as to obtain diffractive optical arrangements, medical devices, microturbines, and so on.

SUMMARY OF THE INVENTION

The present invention is based on the acknowledgement that nano-structured filaments can find important applications in the field of incandescence lamps. In said light, the present invention aims at suggesting a new process to make in a simple and economical way filaments or similar emitters for incandescence light sources, having nanometric reliefs or structures.

Said aim is achieved according to the present invention by a process to make an emitter as referred to above, characterized in that it envisages the use of a layer made of anodized porous alumina as sacrificial element for the selective structuring of the emitter.

The use of the aforesaid alumina layer enables to obtain a plurality of reliefs on at least a surface of the emitter, or a plurality of cavities within the emitter. Said nanometric reliefs or cavities are arranged on the emitter according to a predefined geometry.

Preferred characteristics of the process according to the invention are referred to in the appended claims, which are an integral part of the present description.

BRIEF DESCRIPTION OF THE DRAWINGS

Further aims, characteristics and advantages of the present invention will be evident from the following detailed description and from the accompanying drawings, provided as a mere illustrative, non-limiting example, in which:

FIG. 6 is a schematic perspective view of a portion of a first nano-structured emitter as can be made according to the invention;

FIG. 7 is a schematic perspective view of a portion of a second nano-structured emitter as can be made according to the invention;

FIGS. 8, 9 and 10 are schematic sections showing three different possible implementations of the process according to the invention, as can be used to make a nano-structured emitter as shown in FIG. 6;

DETAILED DESCRIPTION OF THE INVENTION

In all its possible implementations, the process according to the present invention envisages the use of a highly regular film made of anodized porous alumina as sacrificial element or template; depending on the case, said alumina layer is used directly to obtain the desired nano-structured emitter, or indirectly to make a further sacrificial element required to obtain the aforesaid emitter.

Porous alumina films have attracted attention in the past for applications such as dielectric films in aluminum capacitors, films for the retention of organic coatings and for the protection of aluminum substrates.

The structure of porous alumina can be ideally schematized as a network of hollow columns immersed in an alumina matrix. Porous alumina can be obtained by anodization of highly pure aluminum sheets or of aluminum films on substrates like glass, quartz, silicon, tungsten, and so on.

Figure 1:
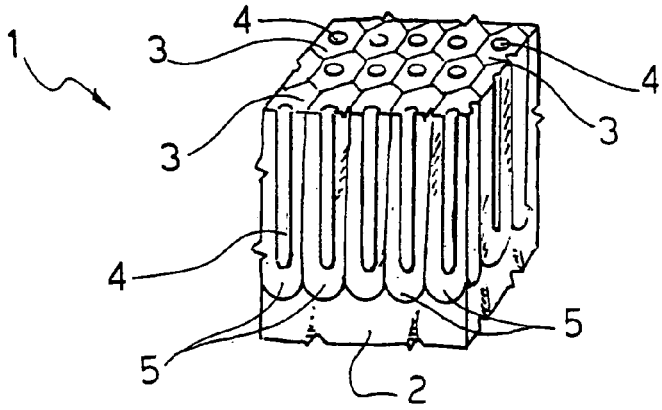
FIG. 1 is a schematic perspective view of a portion of a porous alumina film.

FIG. 1 shows by mere way of example a portion of a porous alumina film, globally referred to with number 1, obtained by anodic oxidation of an aluminum film on a convenient substrate, the latter being referred to with number 2. As can be seen, the alumina layer 1 comprises a series of basically hexagonal cells 3 directly close to one another, each having a straight central hole forming a pore 4, basically perpendicular to the surface of the substrate 2. The end of each cell 3 placed on the substrate 2 has a closing portion with basically hemispheric shape, all closing portions building together a non-porous part of the film 1, or barrier layer, referred to with number 5.

As is known from the prior art, the film 1 can be developed with a controlled morphology by suitably selecting the electrolyte and process physical and electrochemical parameters: in acid electrolytes (such as phosphoric acid, oxalic acid and sulfuric acid) and under suitable process conditions (voltage, current, stirring and temperature), highly regular porous films can be obtained. To said purpose the size and density of cells 3, the diameter of pores 4 and the height of film 1 can be varied; for instance the diameter of pores 4, which is typically of 50-500 nm, can be increased or decreased through chemical treatments.

Figure 2:
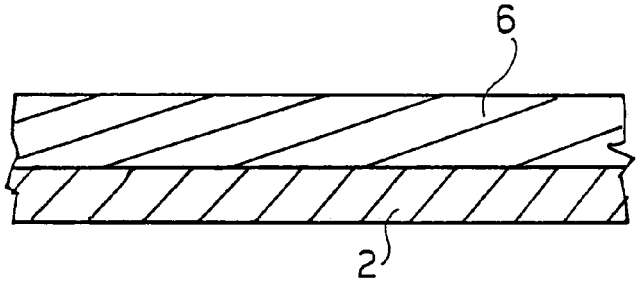
FIGS. 2-5 are schematic views showing some steps of a film-building process for an alumina film as the one shown in FIG. 1.

As schematically shown in FIG. 2, the first step when making a porous alumina film 1 is the deposition of an aluminum layer 6 onto the substrate 2, the latter being for instance made of silicon or tungsten. Said operation requires a deposit of highly pure materials with thicknesses of one micron to 30 microns. Preferred deposition techniques for the layer 3 are thermal evaporation via e-beam and sputtering.

The step including the deposition of the aluminum layer 6 is followed by a step in which said layer is anodized. The anodization process of the layer 6 can be carried out by using different electrolytic solutions depending on the desired size and distance of pores 4.

Should the electrolyte be the same, concentration, current density and temperature are the parameters that greater affect the size of pores 4. The configuration of the electrolytic cell is also important in order to obtain a correct distribution of the shape lines of the electric field with a corresponding uniformity of the anodic process.

Figure 3:
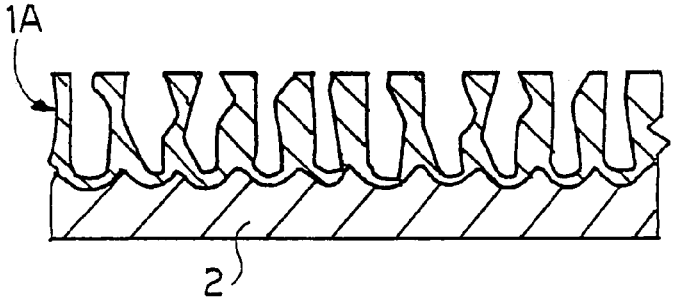
Figure 4:
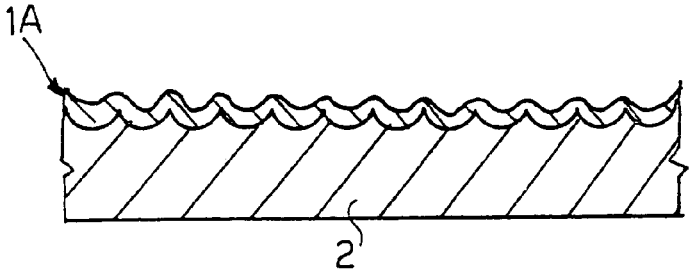

FIG. 3 schematically shows the result of the first anodization of the aluminum layer 6 onto the substrate 2; as schematically pointed out, the alumina film 1A obtained through the first anodization of the layer 6 does not enable to obtain a regular structure. In order to obtain a highly regular structure, such as the one referred to with number 1 in FIG. 1, it is thus necessary to carry out consecutive anodization processes, and in particular at least i) a first anodization process, whose result can be seen in FIG. 3;

ii) a reduction step through etching of the irregular alumina film 6, carried out by means of acid solutions (for instance $CrO_3$ and $H_3PO_4$); FIG. 4 schematically shows the substrate 2 after said etching step;

iii) a second anodization of the part of alumina film 1A that has not been removed through etching.

The etching step referred to in ii) is important so as to define on the residual alumina part 1A preferential areas for alumina growth in the second anodization step.

Figure 5:
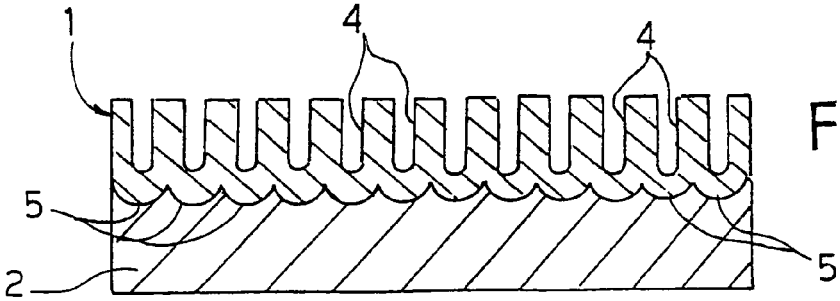

By performing several times the consecutive operations involving etching and anodization, the structure improves until it becomes uniform, as schematically shown in FIG. 5, where the alumina film referred to with number 1 is now regular.

As shall be seen below, in some implementations of the process according to the invention, after obtaining the regular porous alumina film 1, a step involving a total or local removal of the barrier layer 5 is carried out. The barrier layer 5 insulates the alumina structure and protects the underlying substrate 2: the reduction of said layer 5 is therefore fundamental so as to perform, if necessary, consecutive electrodeposition processes requiring an electric contact, and etching processes, in case three-dimensional nano-structures should be obtained directly on the substrate 2.

The aforesaid process involving the removal or reduction of the barrier layer 5 can include two consecutive stages:

widening of pores 4, performed in the same electrolyte as in previous anodization, without passage of current;

reduction of the barrier layer 5, performed by passage of very low current in the same electrolyte as in previous anodization; at this stage the typical balance of anodization is not achieved, thus favoring etching process with respect to alumina-building process.

As mentioned above, according to the invention the alumina film 1 generated through the process previously described is used as template for nano-structuring, i.e. as a base to make structures reproducing the same pattern of alumina. As shall be seen, depending on the selected implementation, it is thus possible to make negative nano-structures, i.e. basically complementary to alumina and therefore having columns on the pores of the film 1, or positive nano-structures, i.e. basically identical to alumina and therefore with cavities on the pores 4 of the film 1.

FIGS. 6 and 7 show in a partial and schematic way two filaments for incandescence light sources having the two types of structures referred to above, which can be carried out according to the invention; the filament referred to with number 10 in FIG. 6 has the aforesaid negative structure, characterized by a base portion 11 from which the aforesaid columns referred to with number 12 start; the filament referred to with number 13 in FIG. 7 has the aforesaid positive structure, characterized by a body 14 in which the aforesaid cavities referred to with 15 are defined.

The techniques suggested to make structured filaments 10, 13 as in FIGS. 6 and 7 can be quite different, and can include in particular addititional techniques (such as evaporation, spittering, Chemical Vapor Deposition, screen printing and electrodeposition), subtractive techniques (etching) and intermediate techniques (anodization of metal underlying alumina).

To this purpose some possible implementations of the process according to the invention are now described in the following.

First Implementation

FIG. 8 schematically shows some steps of a first implementation of the process according to the invention, so as to make negative structures as the one of filament 10 in FIG. 6.

The first four steps of the process include at least a first and a second anodization of a corresponding aluminum layer on a suitable substrate, as previously described with reference to FIGS. 2-5; the substrate 2 can be for instance made of silicon and the aluminum layer for the anodization processes can be deposited by sputtering or e-beam.

After obtaining the film 1 having a regular alumina structure (as can be seen in FIG. 5), the material to be nano-structured is deposited as a film onto alumina through sputtering; thus, as shown by way of example in part a) of FIG. 8, the pores of alumina 1 are filled with the deposited material, tungsten for instance, referred to with number 20.

This is followed by the removal of alumina 1 and of its substrate 2 through etching, as shown in part b) of FIG. 8, thus obtaining the desired filament 10 with negative nano-structure, here made of tungsten.

Sputtering technique consists in depositing films of highly pure material 20 with a thickness of 1 to 30 micron, but does not enable to reproduce structures having a high aspect ratio in an ideal way; the implementation described above is therefore used when the diameter of alumina pores 4 is at its maximum.

Therefore, instead of sputtering, the deposition of material 20 can be performed through Chemical Vapor Deposition or CVD, which is regarded as the most suitable technique for making structures of highly pure or conveniently doped metal. The main feature of this technique is the use of a reaction chamber containing reducing gases, which enable metal penetration into the hollow pores of alumina and the deposit of a continuous layer onto the surface. This ensures a faithful reproduction of high aspect ratio structures.

Second Implementation

As for the previous case, this implementation consists in making negative structures, as the one of filament 10 in FIG. 6; the implementation basically includes the same initial steps as those of the first implementation, as far as the deposition of the aluminum layer 6 onto the substrate 2 (FIG. 2), a first anodization (FIG. 3) and a subsequent etching (FIG. 4) are concerned. The second anodization (FIG. 5) is here performed in order to make a film 1 of thicker porous alumina than in the first implementation.

The thick alumina film 1 is then taken off its support 2 and opened at its base, so as to remove the barrier layer previously referred to with number 5, in a known way. The resulting structure of film 1 without its barrier layer can be seen in part a) of FIG. 9.

Figure 9:
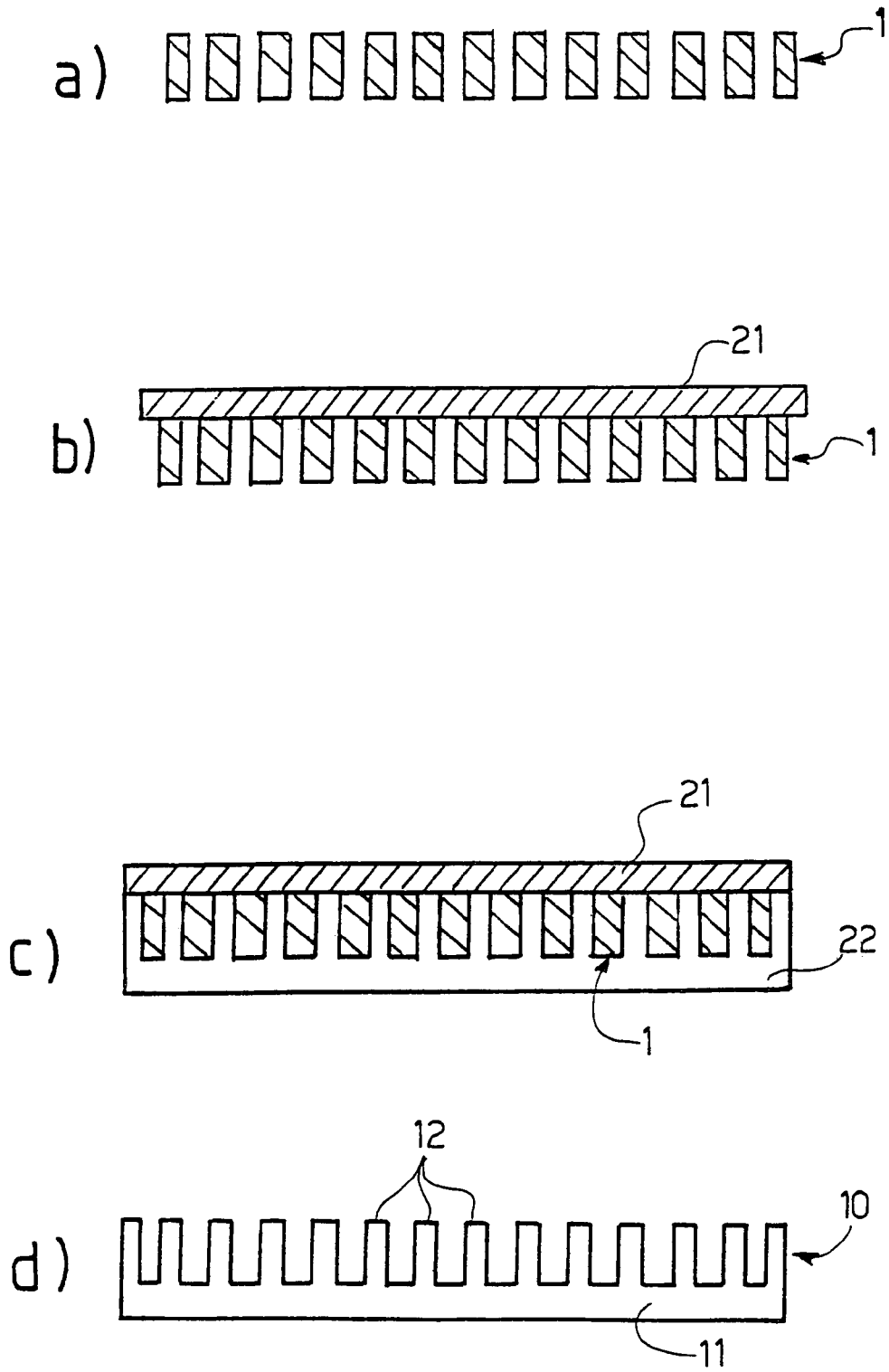

The following step, as in part b) of FIG. 9, consists in the thermal deposition, or deposition through sputtering, of a conductive metal film 21 onto alumina 1. A tungsten alloy 22 is then electrodeposited onto the structure thus obtained, as in part c) of FIG. 9, which alloy fills the pores of alumina 1. Then alumina 1 and its metal film 21 thereto associated are then removed, thus obtaining the desired nano-structured filament 10 made of tungsten alloy, as can be seen in part d) of FIG. 9.

Third Implementation

This implementation consists in making negative structures as the one of filament 10 in FIG. 6, with the same initial steps as those in previous implementations (FIGS. 2-5).

Figure 10:
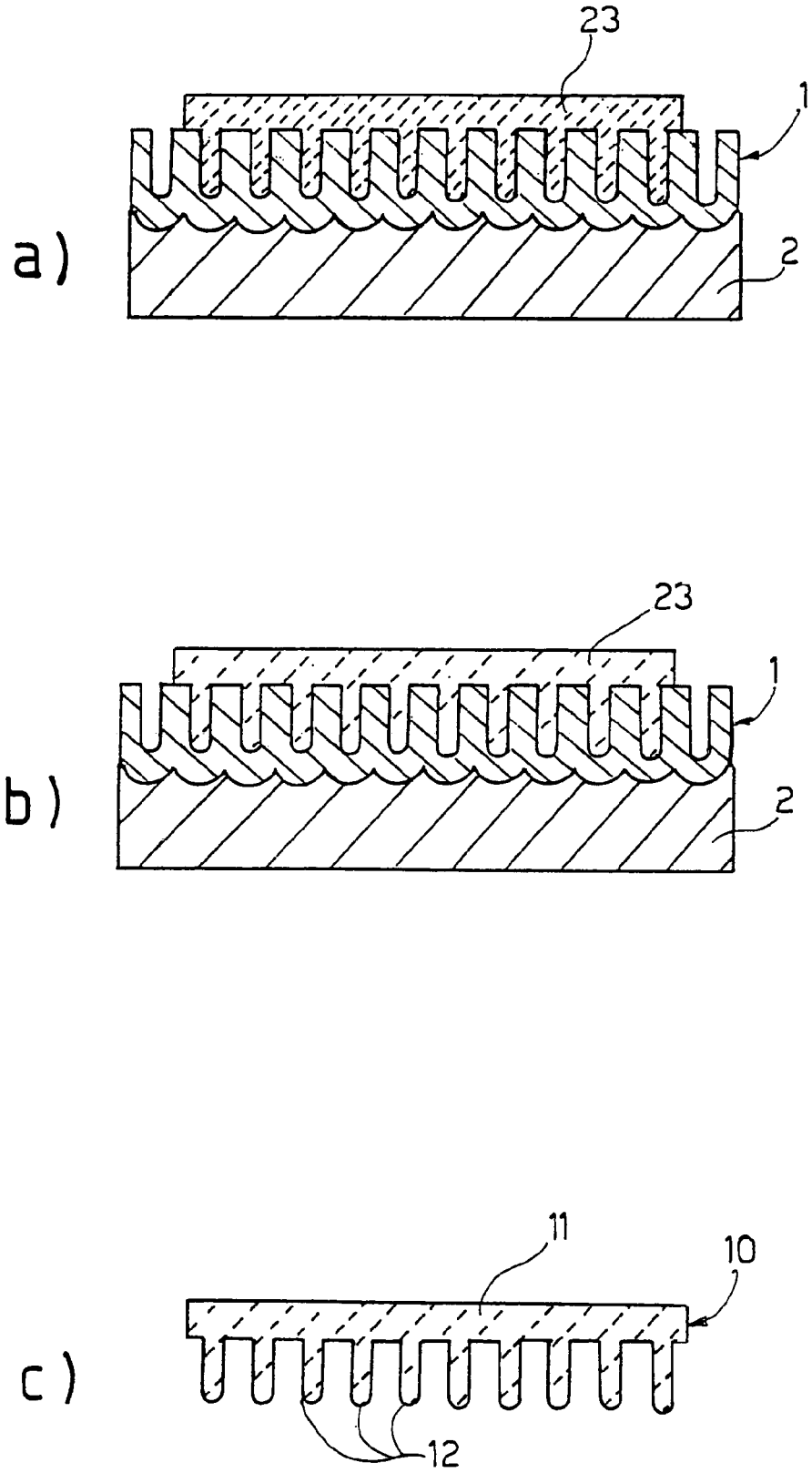

As shown in part a) of FIG. 10, the second anodization is here followed by a step in which a serigraphic paste 23 is deposited onto porous alumina 1, so as to fill its pores.

This is followed by a step in which said paste 23 is sintered, as in part b) of FIG. 10, and then alumina 1 and its substrate 2 are removed, so as to obtain the structure 10 as in part c) of FIG. 10.

This implementation enables to exploit low-cost technologies and ensures flexibility in the choice of materials. The preparation of the serigraphic paste is the first step of the process; the correct choice of the metal nano-powder, for instance comprising tungsten, solvent and binder, is fundamental to obtain a paste having ideal granulometric and rheologic properties for different types of substrates 2.

Fourth Implementation

This implementation of the process according to the invention aims at making positive structures as the one of filament 13 of FIG. 7, starting from a template obtained according to previous implementations.

Figure 11:
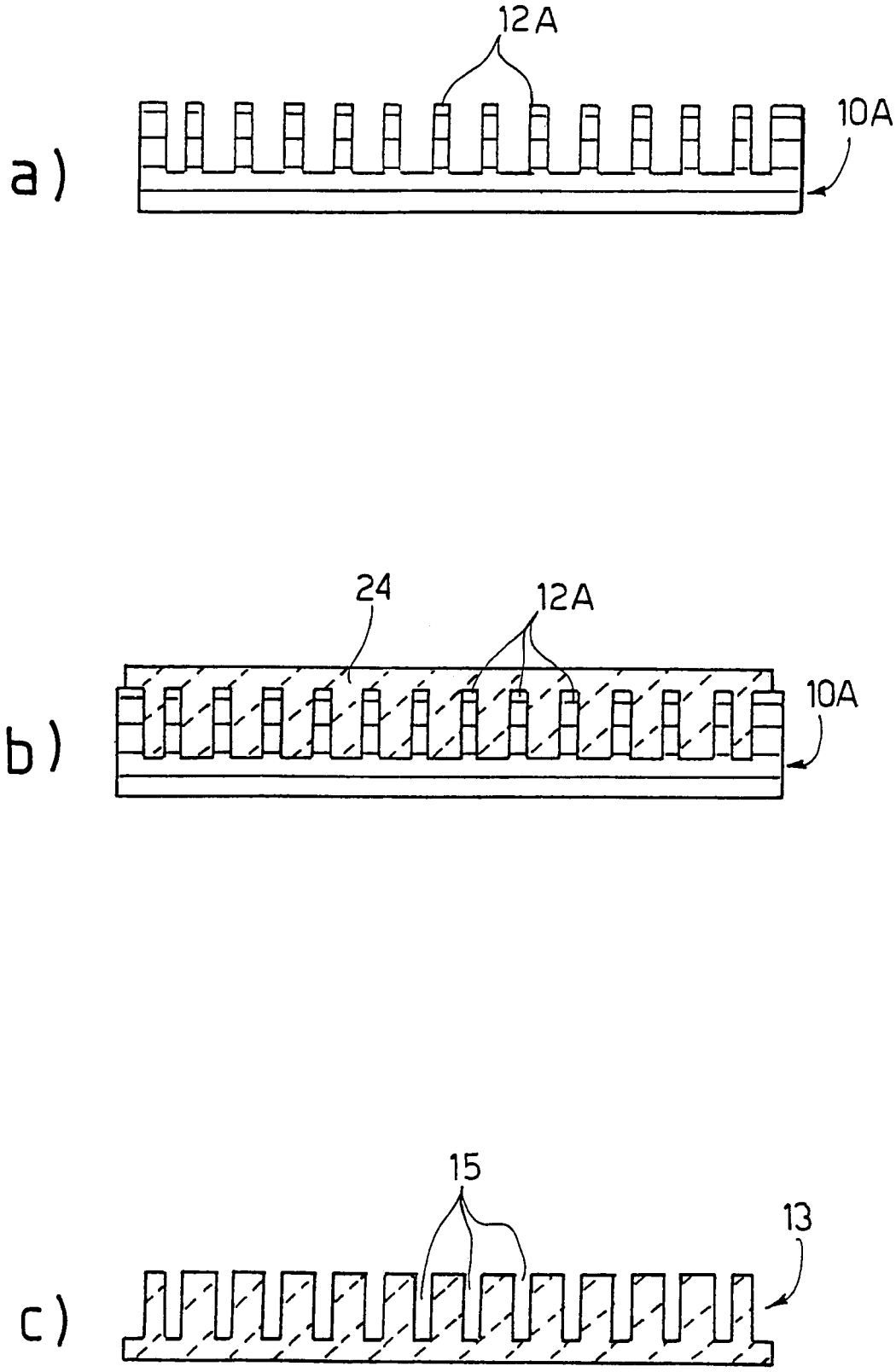
FIGS. 11, 12 and 13 are schematic sections showing three different possible implementations of the process according to the invention, as can be used to make a nano-structured emitter as shown in FIG. 7.

Basically, therefore, one of previous implementations is first used to obtain a substrate having the same structure as the one of filaments previously referred to with number 10; onto said substrate, referred to with number 10A in part a) of FIG. 11, is then deposited a layer of the material 24 required to obtain the final component, for instance tungsten, through sputtering or CVD, as shown in part b) of FIG. 11; the material 24 thus covers the columns 12A of the aforesaid substrates 10A, which acts as a template.

Then the substrate 10A is taken off through selective etching, so as to obtain the filament 13 with positive nano-porous structure, as can be seen in part d) of FIG. 11, provided with corresponding cavities 15.

Figure 12:
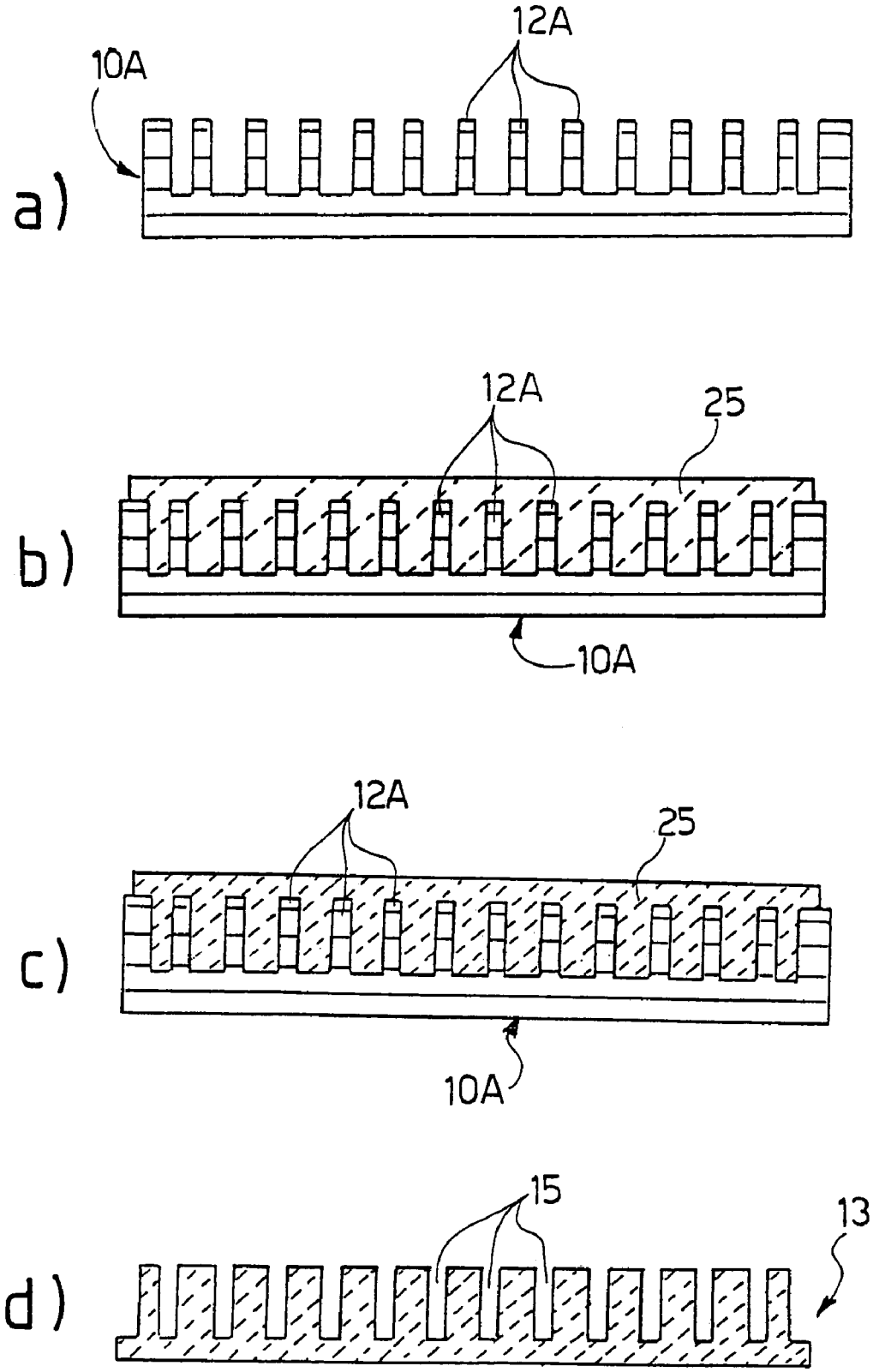

The substrate 10A, obtained according to the first three implementations described above, is not necessarily made of tungsten. In a possible variant, onto the substrate 10A, obtained as in FIGS. 8-9, a metal serigraphic paste 25 is deposited, as in parts a) and b) of FIG. 12, which is then sintered, as in part c) of FIG. 12. The substrate 10A is then taken off through selective etching, so as to obtain the filament 13 with positive nano-porous structure, as can be seen in part d) of FIG. 12.

Fifth Implementation

Also this implementation of the process according to the invention aims at carrying out positive nano-structures as the one of the filament previously referred to with number 13, and includes the same initial steps as those shown in FIGS. 2-5, with the deposition of an aluminum layer 6 through sputtering or e-beam onto a tungsten substrate 2 (FIG. 2), followed by a first anodization of aluminum 6 (FIG. 3) and an etching step (FIG. 4), so as to provide the substrate 2 with preferential areas for the growth of alumina 1 during the second anodization (FIG. 5).

Figure 13:
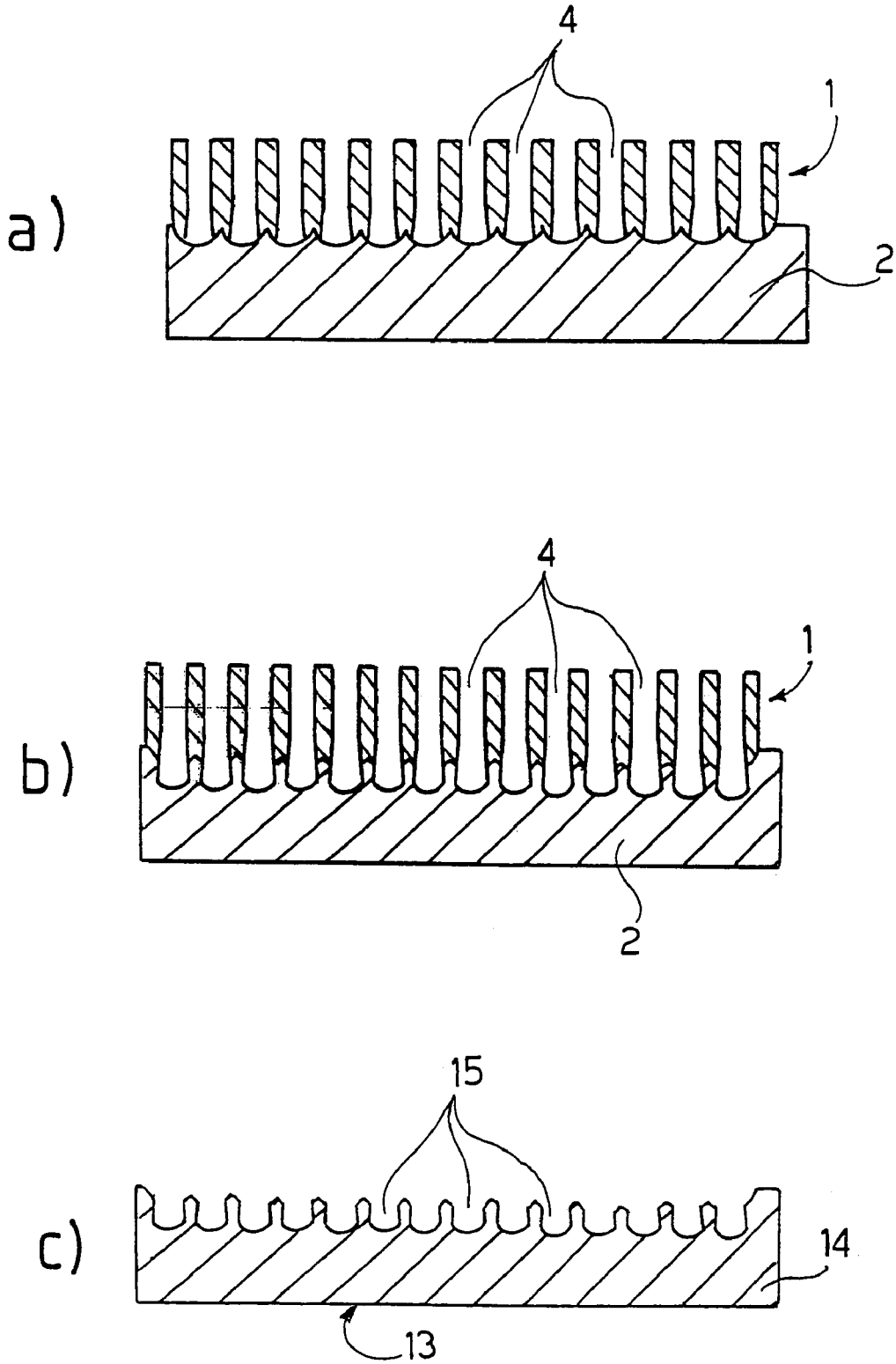

The barrier layer 5 of alumina 1 is then removed, thus opening the pores 4, as can be seen in part a) of FIG. 13. This is followed by a step of Reactive Ion Etching (RIE), which allows to "dig" selectively in the substrate 2 on the open bottom of the pores 4 of alumina 1, as can be seen in part b) of FIG. 13.

The residual alumina 1 is eventually removed, so that the tungsten substrate forms a body 14 with regular nanometric cavities 15, thus obtaining the desired filament 13.

The Reactive Ion Etching step can be replaced, if necessary, by a selective wet etching step or by an electrochemical etching step.

Sixth Implementation

Figure 14:
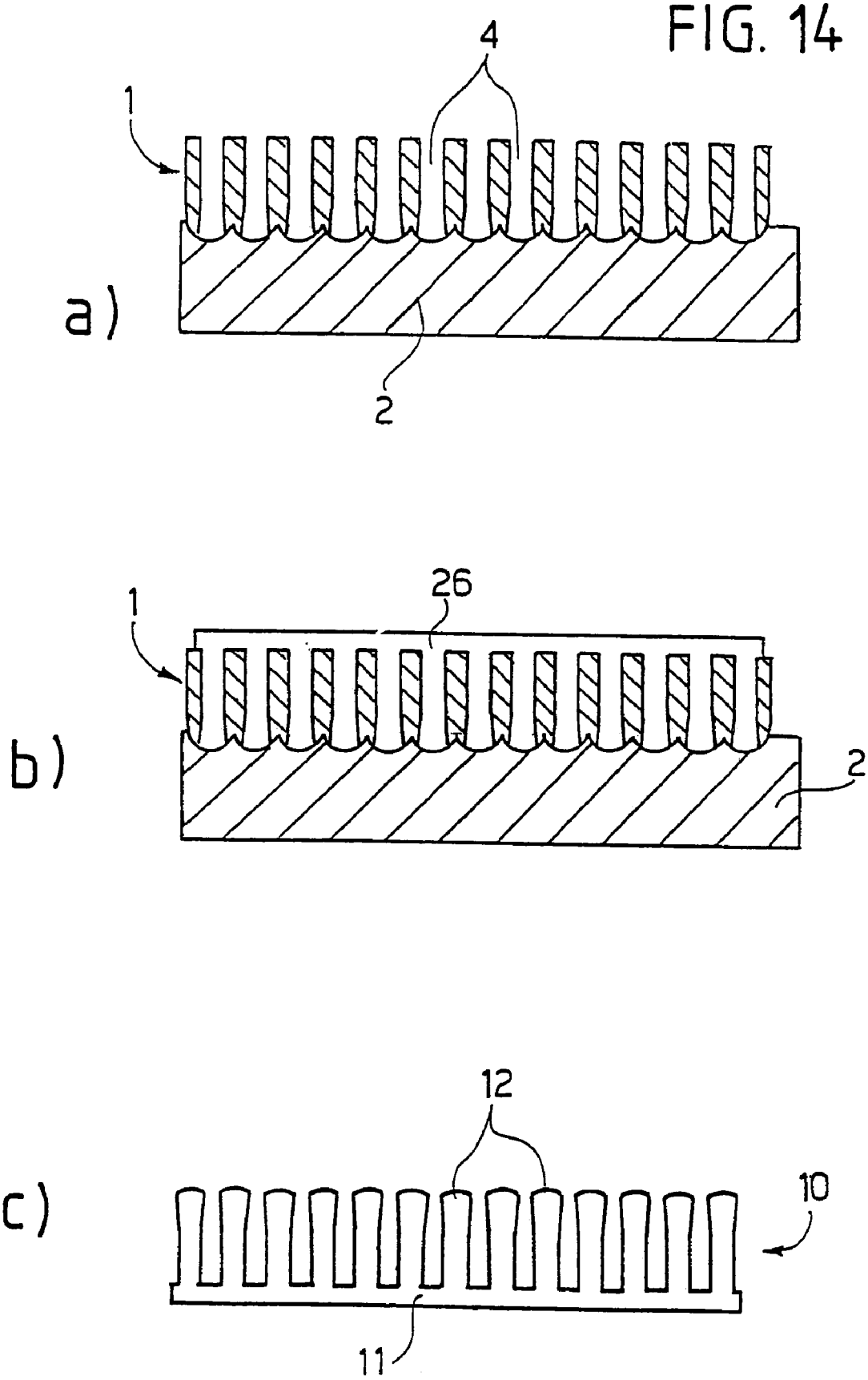
FIG. 14 shows schematic sections of a further possible implementation of the process according to the invention, as can be used to make a nano-structured emitter as shown in FIG. 6.

This implementation of the process aims at making negative structures as the one of filament 10 of FIG. 6 and its initial steps are the same as in previous implementation. Therefore, after obtaining a regular film of alumina 1 on the corresponding tungsten substrate 2 (FIG. 5), the barrier layer 5 is removed, so as to open the pores 4 on the substrate 2, as can be seen in part a) of FIG. 14. This is followed by an electrochemical deposition of a tungsten alloy 26 with pulsed current, as schematically shown in part b) of FIG. 14, and eventually by the removal of residual alumina 1 and of its substrate 2, so as to obtain the desired filament 10, as can be seen in part c) of FIG. 14.

The process 6 first consists in preparing the concentrated electrolytic solution for tungsten deposition into the pores 4 of alumina 1; the electrolyte is very important for correctly filling the pores, since it ensures a sufficient concentration of ions in solution. The pulsed current step enables to carry out the copy of structures with high aspect ratio, and sequentially includes i) the deposition of the tungsten alloy 26 by applying a positive current; this results in a given impoverishment of the solution close to the cathode made of alumina 1 and its substrate 2;

ii) a relax time, without current application, so as to let the solution be re-mixed close to the cathode;

iii) the application of negative current, designed to remove a part of the alloy 26 previously deposited onto the cathode, thus enabling a better leveling of deposited surface.

Steps I), ii) and iii), each lasting for a few milliseconds, are cyclically repeated until the desired structure is obtained.

Seventh Implementation

Figure 15:
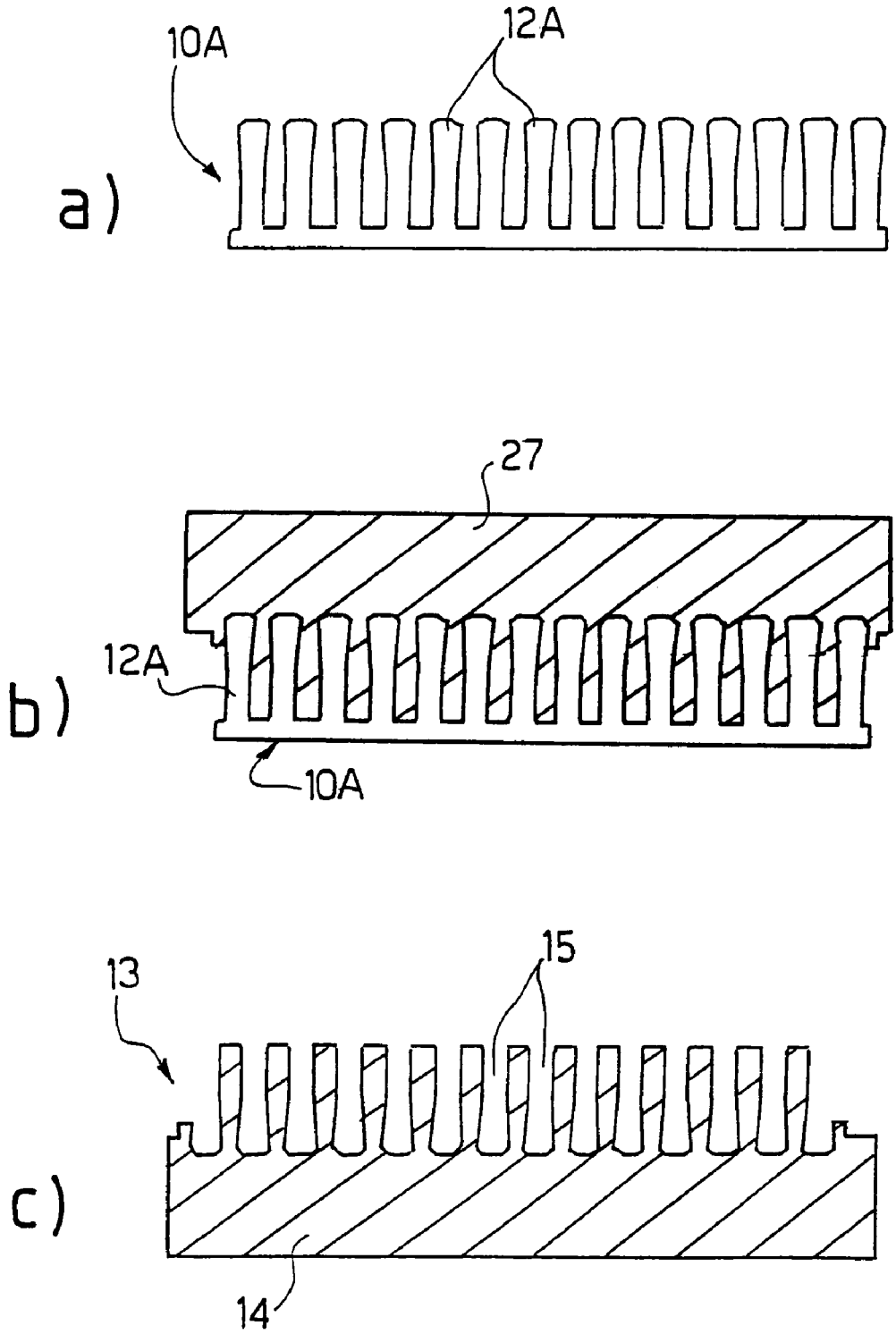
FIG. 15 shows schematic sections of a further possible implementation of the process according to the invention, as can be used to make a nano-structured emitter as shown in FIG. 7.

This implementation aims at making positive nano-structures as the one of filament 13 starting from a substrate with negative structure, obtained through previous implementation, though not necessarily made of tungsten; the aforesaid substrate with negative structure acting as template is referred to with number 10A in part a) of FIG. 15.

A tungsten layer 27 is deposited onto said substrate 10A through CVD or sputtering, as can be seen in part b) of FIG. 15. This is followed by a selective etching step, so as to remove the substrate 10A, thus obtaining the desired filament 13 with tungsten nano-porous structure, as can be seen in part c) of FIG. 15.

Eighth Implementation

This implementation aims at making negative nano-structures as the one of filament 10 of FIG. 6, and its initial steps are the same as those shown in FIGS. 2-5, with the deposition of an aluminum layer 6 through sputtering or e-beam onto a tungsten substrate 2 (FIG. 2), followed by a first anodization of aluminum 6 (FIG. 3) and an etching step (FIG. 4), so as to provide the substrate 2 with preferential areas for the growth of alumina 1 during the second anodization (FIG. 5).

This is followed by a step including the anodization of the tungsten substrate 2, so as to induce the localized growth of the latter, which occurs below the pores 4 of alumina 1. Said step, as shown in part a) of FIG. 16, basically includes the formation of surface reliefs 2A of the substrate 2, which first cause the barrier layer 5 of alumina 1 to break, and then keep on growing within alumina pores 4.

Figure 16:
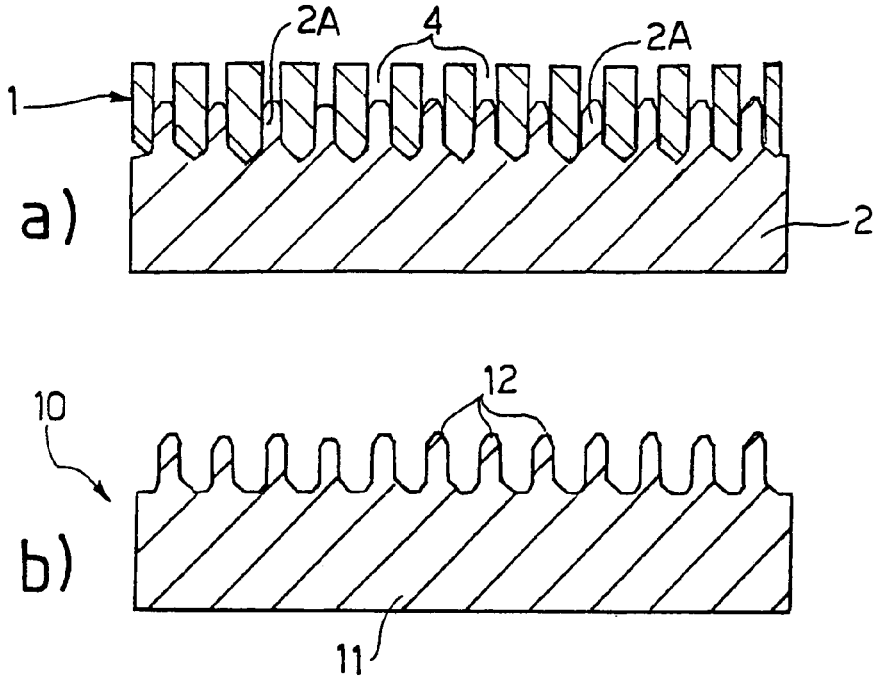
FIG. 16 shows schematic sections of a further possible implementation of the process according to the invention, as can be used to make a nano-structured emitter as shown in FIG. 6.

Through a selective etching with W/W oxide alumina 1 is then removed, so as to obtain the desired filament 10 with negative nano-structure as in part b) of FIG. 16.

It should be noted that this implementation is based on a typical feature of some metals, such as tungsten and tantalum, which anodize under the same chemical and electric conditions as aluminum; as mentioned above, said anodization occurs in the lower portion of the pores 4 of alumina 1, thus directly structuring the surface of the substrate 2.

Ninth Implementation

Figure 17:
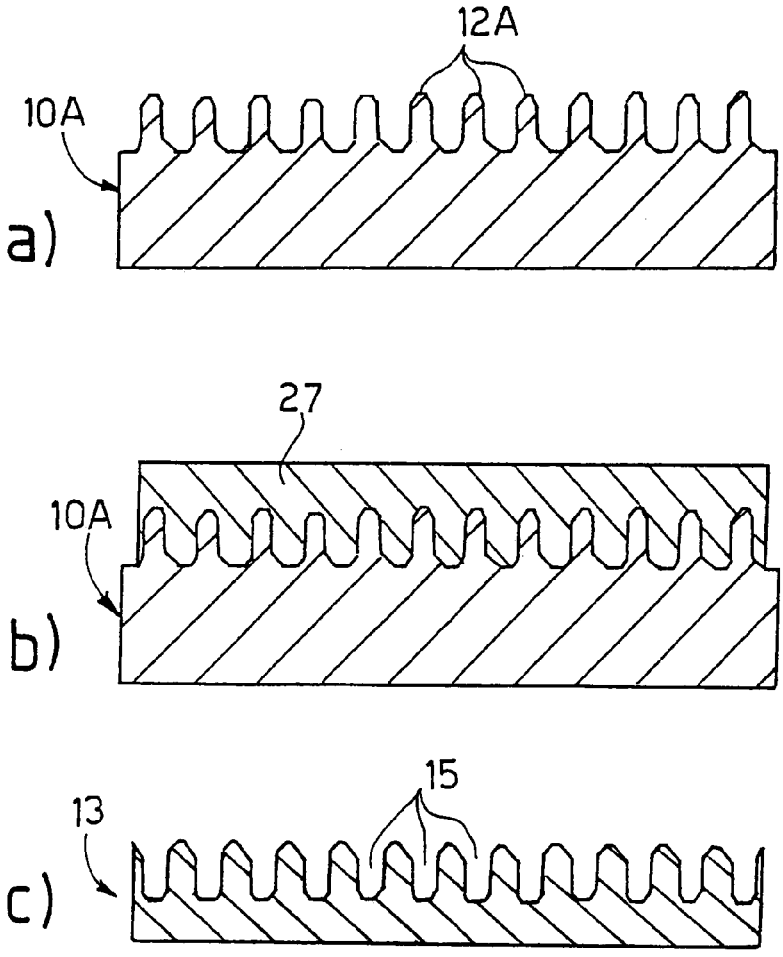
FIG. 17 shows schematic sections of a further possible implementation of the process according to the invention, as can be used to make a nano-structured emitter as shown in FIG. 7.

This implementation aims at carrying out positive nano-porous structures as the one of filament 13 of FIG. 7 starting from a substrate having a negative structure as the one obtained through previous implementation; said substrate acting as template is referred to with number 10A in part a) of FIG. 17.

A tungsten alloy 27 is deposited onto said substrate 10A through electrochemical deposition, CVD or sputtering, as shown in part b) of FIG. 17. The substrate 10A is then removed through selective etching, thus obtaining the desired filament 13 with positive or nano-porous structure.

From the above description it can be inferred that in all described implementations the process according to the invention includes the use of an alumina layer 1 which, depending on the case, directly acts as template so as to obtain the desired filament with nanometric structure 10, or which is used to obtain a template 10A for the subsequent structuring of the desired filament 13.

The invention proves particularly advantageous for the structuring of filaments for incandescence light sources, and more generally of components also under a different form with respect to a filament which can be led to incandescence through a passage of electric current. It should be noticed that an emitter made according to the invention can also be formed by plurality of layers structured by means of porous alumina according to the above describes techniques, in the form of superimposed structured layers.

The described process enables for instance to easily define, on one or more surfaces of a filament, for instance made of tungsten, an antireflection micro-structure comprising a plurality of microreliefs, so as to maximize electromagnetic emission from filament into visible spectrum. The invention can be advantageously applied also to make other photon crystal structures, i.e. in structures made of tungsten or other suitable materials characterized by the presence of series of regular microcavities, which contain a medium with a refractive index differing from the one of tungsten or other material used.

Obviously, though the basic idea of the invention remains the same, construction details and embodiments can widely vary with respect to what has been described and shown by mere way of example.

What is claimed is:

1. A method of making an electrically conductive incandescence emitter for incandescence light sources, comprising:

providing a layer of tungsten or a tungsten alloy;

using as a sacrificial element for the structuring of at least a part of the layer of tungsten or tungsten alloy a layer made of anodized porous alumina;

wherein said emitter can be led to incandescence through the passage of electric current through the layer of tungsten or tungsten alloy.

2. The method according to claim 1, wherein said structuring comprises obtaining at least one of a plurality of nanometric reliefs arranged according to a predefined geometry on at least a surface of the emitter, and a plurality of nanometric cavities arranged according to a predefined geometry within the emitter.

3. The method according to claim 2, wherein the alumina layer is obtained through consecutive anodizations of an aluminum film deposited onto a surface of a substrate until a regular alumina structure is obtained, which defines a plurality of pores substantially perpendicular to said surface of the substrate, the alumina layer having a non-porous portion close to the respective substrate.

4. The method according to claim 3, wherein the alumina layer is used either as a sacrificial template during said structuring or as an intermediate template for obtaining a further sacrificial template for said structuring.

5. The method according to claim 2, wherein said structuring comprises deposition of material by evaporation, sputtering, Chemical Vapor Deposition, screen printing or electrodeposition.

6. The method according to claim 2, wherein said structuring comprises etching.

7. The method according to claim 2, wherein said structuring comprises anodization of a metal underlying the alumina layer.

8. The method according to claim 4, wherein said structuring comprises:

the material designed to make up the desired component having a plurality of reliefs is deposited as a film onto the alumina layer, a part of said material filling said pores, and the alumina layer and its substrate are then removed, obtaining the desired component, whose reliefs comprise the part of said material which filled said pores.

9. The method according to claim 8, wherein said material is deposited onto the alumina layer through sputtering or Chemical Vapor Deposition.

10. The method according to claim 4, wherein said structuring comprises:

the alumina layer is removed from its substrate and opened at its base, removing its nonporous portion, conductive metal film is deposited onto the alumina layer, the material designed to make up a desired component having a plurality of reliefs is electrodeposited onto the structure formed by the metal film and the residual part of the alumina layer, a part of said material filling said pores, and the residual part of the alumina layer and the metal film are then removed, obtaining the desired component, whose reliefs comprise the part of said material which filled said pores.

11. The method according to claim 4, wherein said structuring comprises:

the material designed to make up the desired component having a plurality of reliefs is deposited as a serigraphic paste onto the alumina layer, a part of said paste filling said pores, said paste is sintered, and the alumina layer and its substrate are then removed, obtaining the desired component, whose reliefs comprise the part of said material which filled said pores.

12. The method according to claim 4, wherein said structuring comprises:

localized parts on the non-porous portion of the alumina layer are removed, to open said pores on their substrate, and the material designed to make up a desired component having a plurality of reliefs is deposited through electrochemical methods onto the residual part of the alumina layer, a part of said material filling said pores and getting into contact with their substrate, and the residual part of the alumina layer and its substrate are then removed, obtaining the desired component, whose reliefs comprise the part of said material which filled said pores.

13. The method according to claim 4, wherein the structuring comprises:

the substrate of the alumina layer undergoes anodization, to induce a growth of the substrate below said pores, said growth resulting in the formation of surface projections of the substrate, which first cause parts of the nonporous portion of the alumina layer to break and then keep on growing within said pores, and the alumina layer is removed through selective etching, a desired component having a plurality of reliefs being made by the substrate, said surface projections comprising said reliefs.

14. The method according to claim 8, wherein said desired component is said emitter.

15. The method according to claim 8, where said desired component is said further template.

16. The method according to claim 15, wherein said structuring comprises:

a layer of the material designed to make up said emitter is deposited onto said further template, and said further template is removed to obtain said emitter.

17. The method according to claim 15, wherein said structuring comprises:

a layer of the material designed to make up said emitter is deposited onto said further template, and said further template is removed to obtain said emitter.

18. The method according to claim 15, wherein said structuring comprises:

a layer of the material designed to make up said emitter is deposited onto said further template, and said further template is removed to obtain said emitter.

19. The method according to claim 16, wherein the material designed to make up said emitter is deposited onto said further template through sputtering or Chemical Vapor Deposition, and said further template is removed through selective etching.

20. The method according to claim 16, wherein the material designed to make up said emitter is in the form of a serigraphic paste, which is sintered after being deposited onto said further template the latter being then removed through selective etching.

21. The method according to claim 5, wherein said structuring comprises:

at least a part of the non-porous portion of the alumina layer is removed, said pores being opened on their substrate, the substrate is selectively dug in the corresponding open areas on said pores, and the residual part of the alumina layer is removed, the substrate comprising said emitter, the dug areas of the substrate comprising said cavities.

22. The method according to claim 21, wherein the substrate is dug on said open areas through Reactive Ion Etching or selective wet etching or electrochemical etching.

* * * * *